US012180032B2

(12) United States Patent
Mock et al.

(10) Patent No.: US 12,180,032 B2
(45) Date of Patent: Dec. 31, 2024

(54) REEL ASSEMBLY FOR A HOUSING

(71) Applicant: HUSQVARNA AB, Huskvarna (SE)

(72) Inventors: Axel Mock, Blaustein (DE); Tobias Schlegel, Illerkirchberg (DE); Christoph Schenk, Oberdischingen (DE)

(73) Assignee: HUSQVARNA AB, Huskvarna (SE)

( * ) Notice: Subject to any disclaimer, the term of this patent is extended or adjusted under 35 U.S.C. 154(b) by 0 days.

(21) Appl. No.: 18/564,773

(22) PCT Filed: Dec. 21, 2021

(86) PCT No.: PCT/EP2021/087040
§ 371 (c)(1),
(2) Date: Nov. 28, 2023

(87) PCT Pub. No.: WO2022/248077
PCT Pub. Date: Dec. 1, 2022

(65) Prior Publication Data

US 2024/0253943 A1 Aug. 1, 2024

(30) Foreign Application Priority Data

May 28, 2021 (EP) ..... 21176488

(51) Int. Cl.
*B65H 75/44* (2006.01)

(52) U.S. Cl.
CPC ..... *B65H 75/4471* (2013.01); *B65H 75/4431* (2013.01); *B65H 75/4481* (2013.01); *B65H 2701/33* (2013.01)

(58) Field of Classification Search
CPC ..... B65H 75/4418; B65H 75/4428; B65H 75/4431; B65H 75/4411; B65H 75/44
See application file for complete search history.

(56) References Cited

U.S. PATENT DOCUMENTS 4,227,661 A * 10/1980 King ..... B65H 75/4471 137/355.27
4,311,165 A 1/1982 Rose, Jr.
(Continued)

FOREIGN PATENT DOCUMENTS

CN 102753461 A 10/2012
CN 109160394 A 1/2019
(Continued)

OTHER PUBLICATIONS

International Search Report and Written Opinion of corresponding International Application No. PCT/EP2021/087040 mailed Mar. 22, 2022, all pages cited in its entirety.
(Continued)

*Primary Examiner* — Sang K Kim
(74) *Attorney, Agent, or Firm* — Burr & Forman LLP

(57) ABSTRACT

A reel assembly (100) for coupling within a housing (160) includes an axle (110) and a reel (120) defining a rotational axis (X-X'). The reel (120) is rotatably mounted around the axle (110) to allow winding of a flexible linear component (130) on the reel (120). The reel assembly (100) further includes a frame (140) which houses the reel (120). Moreover, the reel assembly (100) includes one or more fixing units (150) to removably fix the reel assembly (100) inside the housing (160). The reel assembly (100) is characterized in that the reel assembly (100) further includes a blocking mechanism (170) that operatively couples with the reel assembly (100) and cooperates with the reel (120) for selective rotation of the reel (120). The blocking mechanism (170) disallows rotation of the reel (120) in absence of coupling of the reel assembly (100) within the housing (160).

15 Claims, 9 Drawing Sheets

(56) References Cited

U.S. PATENT DOCUMENTS

| | | | | |
|---|---|---|---|---|
| 4,793,376 | A * | 12/1988 | Hare | B65H 75/4471 137/355.27 |
| 2013/0161439 | A1 | 6/2013 | Beery et al. | |

FOREIGN PATENT DOCUMENTS

| | | | |
|---|---|---|---|
| CN | 210286340 | U | 4/2020 |
| DE | 102005031527 | A1 | 1/2007 |
| EP | 1771372 | A2 | 4/2007 |
| WO | 2011114081 | A1 | 9/2011 |
| WO | 2019206395 | A1 | 10/2019 |

OTHER PUBLICATIONS

International Preliminary Report on Patentability of corresponding International Application No. PCT/EP2021/087040 mailed May 3, 2023, all pages cited in its entirety.

* cited by examiner

REEL ASSEMBLY FOR A HOUSING

TECHNICAL FIELD

The present disclosure relates to a reel assembly. More specifically, the present disclosure relates to a reel assembly which generally finds application in an underground housing.

BACKGROUND

Garden or watering hose are universal pieces of household equipment, and various devices (say gardening devices) are available for storing such a flexible, elongate, and cumbersome article. As a result, such devices range from a simple spike in a wall, post, or the like from which the coiled hose may be hung, to more elaborate stationary racks and revolving reels such as a hose box.

In each of the above cases, the hose is still generally stored outdoors, where it detracts from the decor and is vulnerable to theft or other damage. The hose may alternatively be stored indoors, but the retrieval of the hose from its indoor storage area and deployment out of doors, unnecessarily complicates the task. Accordingly, there is a need for a hose reel assembly (or simple reel assembly) which may be permanently installed in a readily accessible location, preferably in an underground housing and like installation. There have also been efforts to protect and avoid inadvertent unwinding events of the hose while in storage within the hose reel assembly but outside the housing. Such requirements of the hose reel assembly further require a safe, efficient, and trouble-free application of the hose of the hose reel assembly. The hose reel assembly and housing may be installed underground beneath the surface, as in a lawn or other planted area, with easy and user-friendly access for service and other maintenance events.

An example of an underground hose reel assembly and housing is provided by WIPO patent application 2019/206395 (hereinafter referred to as the '395 reference). The '395 reference discloses a high-pressure cleaning device having a housing on which two running wheels are mounted for rotation about a common axis of rotation and in which a motor and a pump driven by the motor are arranged. A pressure hose fluidically connected to an outlet of the pump and a winding apparatus is provided which has a rotatably mounted hose drum for winding and unwinding the pressure hose. The high-pressure cleaning device can be tilted about the axis of rotation of the running wheels from a usage position into a transport position. The winding apparatus has a restoring spring and a blocking mechanism. The restoring spring can be loaded by unwinding the pressure hose from the hose drum and the hose drum can be set into rotation by the restoring spring in order to automatically wind the pressure hose. The hose drum can be automatically locked by means of the blocking mechanism and released by application of a tensile force to the pressure hose.

Another example is provided in German patent application 10-2005-031-527 (hereinafter referred to as '527 reference). The '527 reference provides a storage device, which has an outer geometry for detachedly holding in a ground shaft. The storage device has a side part on which moves a storage drum. The storage device has guiding rollers. The storage drum has a spring unit for winding the garden hose on the drum. The drum has a locking unit for locking the drum to prevent unintentional winding of the hose. However, the '527 reference seems short of disclosing blocking of the turning of the drum when the storage device is outside the ground shaft. Such downsides may limit application of the storage device in places having advanced safety and statutory requirements.

Thus, there is a need for an improved reel assembly which allows safe and efficient application of a hose and the like, particularly suitable for underground installations.

SUMMARY

In view of the above, it is an objective of the present invention to solve or at least reduce the drawbacks discussed above. The objective is at least partially achieved by a reel assembly of a watering hose for coupling within a housing. The reel assembly includes an axle and a reel defining a rotational axis. The reel is rotatably mounted around the axle to allow winding of the watering hose on the reel. The reel assembly further includes a frame which houses the reel. Moreover, the reel assembly includes one or more fixing units to removably fix the reel assembly inside the housing. The housing includes a pair of side walls and a pair of front walls. At least one of the pair of side walls and the pair of front walls includes a housing inlet. The housing inlet is or can be associated with a water connector to fluidly couple the watering hose with a fluid line or hose to supply water from an external fluid source.

Further, the reel assembly is characterized in that the reel assembly further includes a blocking mechanism that operatively couples with the reel assembly and cooperates with the reel for selective rotation of the reel. The blocking mechanism disallows rotation of the reel in absence of coupling of the reel assembly within the housing.

Thus, the present disclosure provides a simple, efficient, and safe reel assembly suitable for applications with the underground housing, while selectively restricting undesirable movement (say unwinding) of the hose for the reel assembly outside the housing. The reel assembly includes the blocking mechanism which disallows rotation of the reel (and the hose thereby) when the reel assembly is taken outside the housing for repair, storage in wintertime or other reasons. The blocking mechanism of the reel assembly allows to meet statutory requirement and helps to avoid injury to a user due to accidental rotation of the reel. Further, application of the blocking mechanism allows to avoid unnecessary effort (say due to inadvertent hose unwinding) on the part of the user to maintain the hose intact on the hose reel. The blocking mechanism may also prevent dripping of left-over water from the hose to the ground surface, that would otherwise happen if the reel accidentally rotates. The blocking mechanism also avoids unnecessary frictional contact of the hose and therefore avoids wear and tear of the hose.

According to an embodiment of the present disclosure, the water connector removably couples with the fluid line or hose to supply water from the external fluid source. The removable feature of the water connector may also allow easy maintenance and cleaning of the water connector or the associated parts.

According to an embodiment of the present disclosure, a disconnection of the water connector and the fluid line or hose seals the fluid line or hose to stop the supply of water from the external fluid source. This may lead to judicious use of water and reduce wastage. This may also prevent unnecessary accumulation of water around the housing, which may otherwise further affect the working of the reel assembly or degrade the material of the housing in long run.

According to an embodiment of the present disclosure, the disconnection and sealing of the fluid line or hose takes place automatically in the absence of coupling of the water connector. The automatic feature may allow for quick and efficient disconnection and sealing of the fluid line or hose which may otherwise be a clumsy, inefficient, and time-consuming task.

According to an embodiment of the present disclosure, the blocking mechanism is a turning block in the form of a movable screw or a bolt that is fixed to the frame. The turning block is one or more of substantially parallel, perpendicular, or pivoted with respect to the rotational axis of the reel. The choice of the blocking mechanism may depend upon the type, dimension, service life and other factors related to the hose and the reel assembly. Preferably, the blocking mechanism may be a movable screw or bolt, which is easy to install, easily serviceable and available in different shapes and sizes to cater to the need of different applications.

According to an embodiment of the present disclosure, the blocking mechanisms automatically interacts with the reel to prevent its rotation, when not coupled with the housing. This allows efficient and safe application of the blocking mechanism due to automatically blocking the rotation of reel, while not requiring any human intervention.

According to an embodiment of the present disclosure, the frame also includes a grip or a handle. The user may grip the handle to pull out the frame of the reel out of the housing. Thus, provision of handle on the frame allows easy removal of the reel assembly out of the housing for repair, storage in wintertime or other reasons.

According to an embodiment of the present disclosure, the blocking mechanism gets automatically activated when the reel assembly is manipulated. This may ensure that when the hose reel assembly is displaced from its storage position, the reel rotation is blocked. Also, if due to any external factors (say environmental disturbances), the reel assembly dislocates from its storage position, the reel rotation is automatically blocked.

According to an embodiment of the present disclosure, the grip or handle includes a switch or a button to trigger the blocking mechanism to prevent the rotation of the reel. The provision of the switch or the button on the handle makes the blocking mechanism ergonomic and easy to operate. The switches and the button are inexpensive, simple to attach, replace and take up less space on the handle.

According to an embodiment of the present disclosure, the housing includes an actuator which engages with the blocking mechanism of the reel assembly. The actuator engages with the blocking mechanism to unlock or allow rotation of the reel from the blocking mechanism, during coupling of the housing and the reel assembly.

According to an embodiment of the present disclosure, the blocking mechanisms is manually actuable to allow or disallow the rotation of the reel. The provision of manual actuation of the blocking mechanism allows a user to block the rotation of the reel according to different application requirements.

According to an embodiment of the present disclosure, the reel assembly further includes a drive mechanism configured to drive the reel to wind and unwind the flexible linear component. The present disclosure may be readily implemented with any driving mechanism such as the spring or the electric motor to drive the reel to wind or unwind flexible linear components used in varied application fields such as gardening, electric installations etc.

According to an embodiment of the present disclosure, the drive mechanism is selected from the group including a spring, and an electric motor. The choice of the drive mechanism may be dependent on different factors such as a power source, application location, maintenance, and the like.

According to an embodiment of the present disclosure, the one or more fixing units is selected from the group including one or more of a railing system and a screwing mechanism. Such fixing units may allow for easy adjustment of the frame, easy to install, user friendly among other implementation benefits.

According to an embodiment of the present disclosure, the flexible linear component is one or more of a hose, wire, and cable. The flexible linear component may be used for watering, supplying power, lifting loads etc.

Other features and aspects of this invention will be apparent from the following description and the accompanying drawings.

BRIEF DESCRIPTION OF THE DRAWINGS

The invention will be described in more detail with reference to the enclosed drawings, wherein.

DESCRIPTION OF EMBODIMENTS

Figure 1:
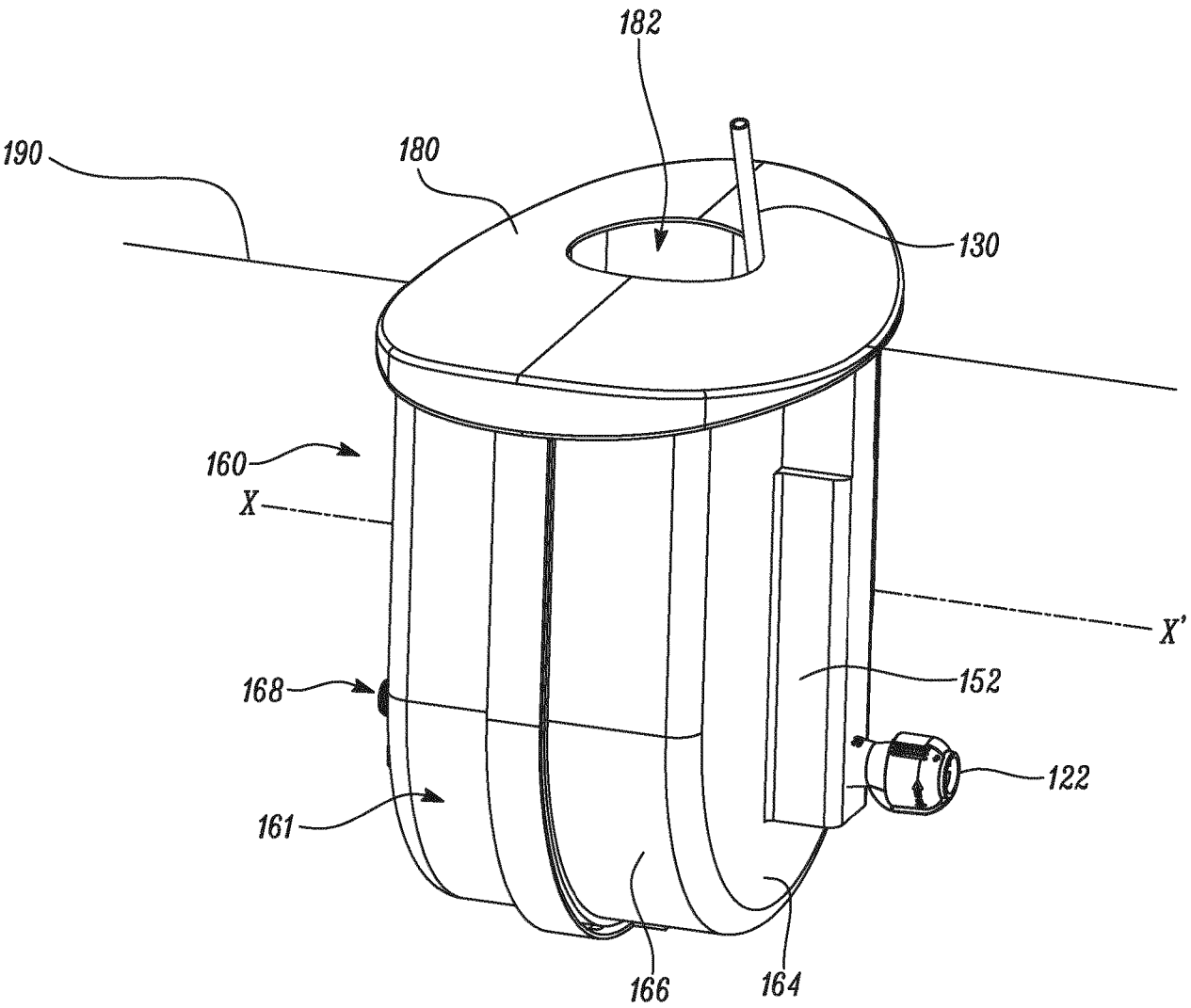
FIG. 1 shows a perspective view of a housing which houses a reel assembly, in accordance with an aspect of the present disclosure.

The present invention will be described more fully hereinafter with reference to the accompanying drawings, in which example embodiments of the invention incorporating one or more aspects of the present invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. For example, one or more aspects of the present invention may be utilized in other embodiments and even other types of structures and/or methods. In the drawings, like numbers refer to like elements.

Certain terminology is used herein for convenience only and is not to be taken as a limitation on the invention. For example, "upper", "lower", "front", "rear", "side", "longitudinal", "lateral", "transverse", "upwards", "downwards", "forward", "backward", "sideward", "left," "right," "horizontal," "vertical," "upward", "inner", "outer", "inward", "outward", "top", "bottom", "higher", "above", "below", "central", "middle", "intermediate", "between", "end", "adjacent", "proximate", "near", "distal", "remote", "radial", "circumferential", or the like, merely describe the configuration shown in the Figures. Indeed, the components may be oriented in any direction and the terminology, therefore, should be understood as encompassing such variations unless specified otherwise.

Figure 2:
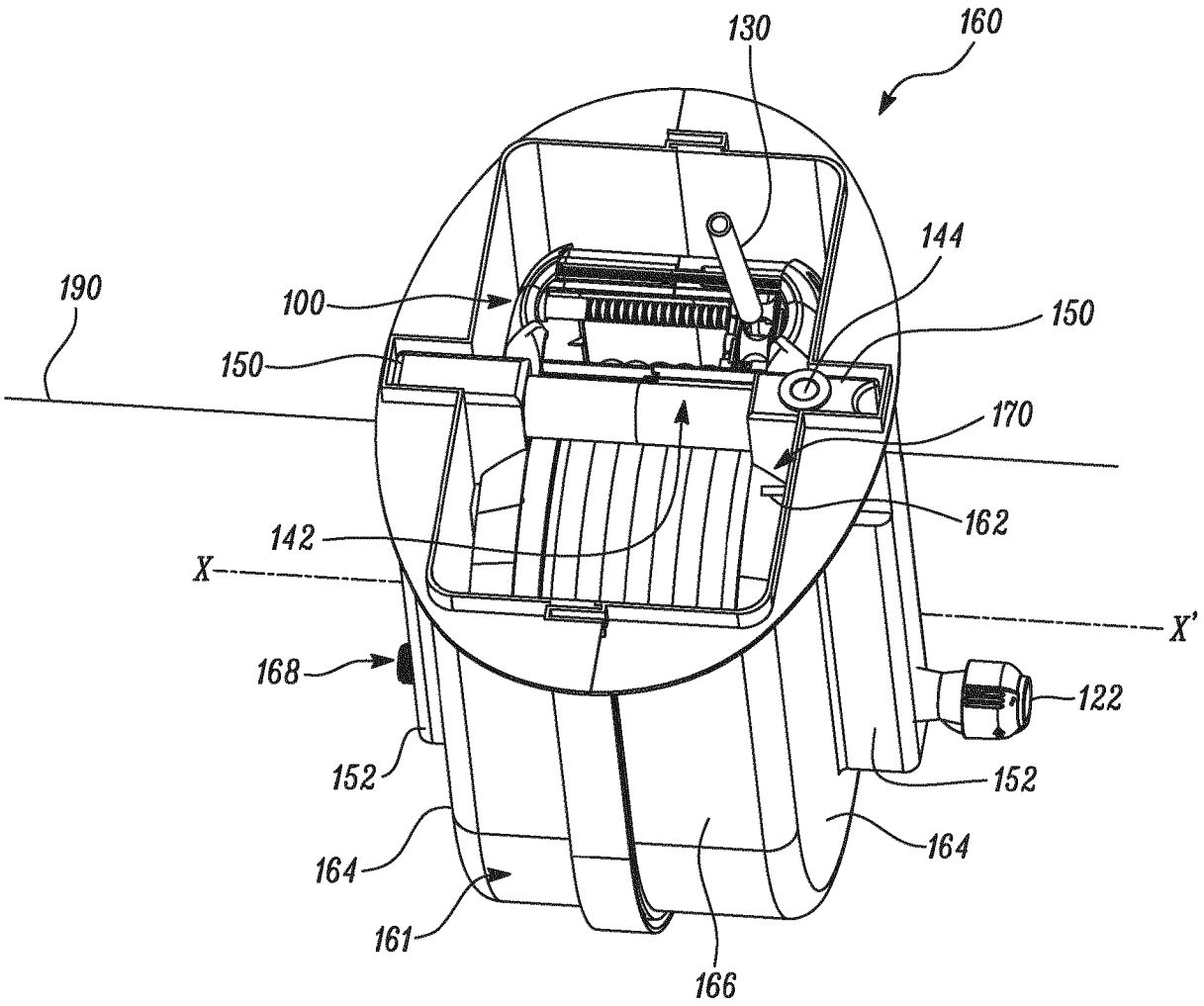
FIG. 2 shows a perspective view of a housing without a cover to display a reel assembly, in accordance with an aspect of the present disclosure.
Figure 3:
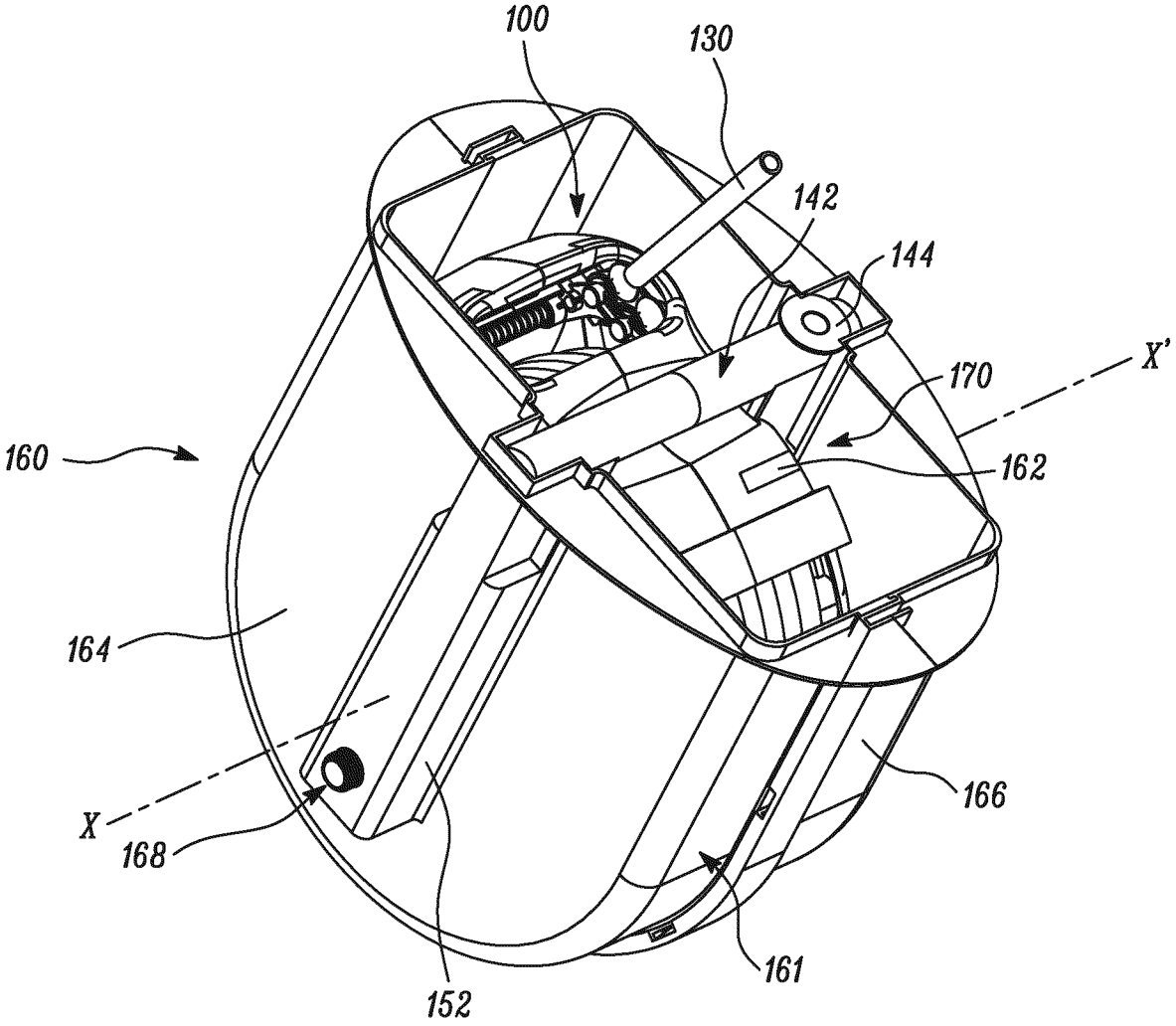
FIG. 3 shows another perspective view of a housing without a cover to display a reel assembly, in accordance with an aspect of the present disclosure.

FIGS. 1, 2 and 3 illustrate a housing 160 and a reel assembly 100 coupled within the housing 160. The housing 160 of the present disclosure generally finds application in underground applications, such as in outdoor and garden installations. The housing 160 is fixed (preferably permanently) underground (say in a garden) while the reel assembly 100 may be taken outside the housing 160 for repair, or storage in wintertime or for other reasons. The reel assembly 100 of the present disclosure may find application to wound a watering hose 130. The watering hose 130 may be used for watering. For the present disclosure, the watering hose 130 is illustrated as a hose which finds application with the reel assembly 100 illustrated as a hose box.

As illustrated in FIGS. 1, 2 and 3, the housing 160 includes a body 161. The body 161 further includes a pair of side walls 164, a pair of front walls 166 and a hollow top covered by a cover 180. The side walls 164 include rails 152 to removably fix the reel assembly 100 to the housing 160. At least one of the pair of side walls 164 or the pair of front walls 166 includes a housing inlet 168. The housing inlet 168 may be a fluid connector and the like, to removably couple with a fluid line or hose (not shown) to supply water from an external fluid source (not shown) to the housing 160. The housing inlet 168 of the housing 160 is further fluidly connected to the watering hose 130 wounded on the reel assembly 100, when the reel assembly 100 is coupled with the housing 160. The housing inlet 168 being associated with a water connector 122 to fluidly couple the watering hose 130 with the fluid line or hose to supply water from an external fluid source.

In some embodiments, the water connector 122 may removably couple with the fluid line or hose to supply water from the external fluid source. The removable feature of the water connector 122 may also allow easy maintenance and cleaning of the water connector 122 or the associated parts. In some embodiments, a disconnection of the water connector 122 and the fluid line or hose seals the fluid line or hose to stop the supply of water from the external fluid source. This may lead to judicious use of water and reduce wastage. This may also prevent unnecessary accumulation of water around the housing 160, which may otherwise further affect the working of the reel assembly 100 or degrade the material of the housing 160 in long run. In some embodiments, the disconnection and sealing of the fluid line or hose takes place automatically in the absence of coupling of the water connector 122. The automatic feature may allow for quick and efficient disconnection and sealing of the fluid line or hose which may otherwise be a clumsy, inefficient, and time-consuming task.

In some embodiments, the housing 160 is preferably made of plastic and is advantageously made using a plastic injection molding process. The housing 160 may have semi-circular shape, cylindrical shape, or any other shape feasible to accommodate and couple with the reel assembly 100.

The cover 180 of the housing 160 preferably provides a weather tight seal for the underlying reel assembly 100. The cover 180 is preferably located in a coplanar manner with the ground surface 190 to permit mowing and, other work to be accomplished thereover without impedance. The cover 180 may be hinged, pivoted, or otherwise secured to the top of the housing 160 in such a way that it is stable against the vacuum force of rotating mower blades. Further, the cover 180 includes a hole 182, which may be used for inspection of the reel assembly 100 and direct winding and unwinding of hose 130 without having to remove the cover 180. Removal or opening of the cover 180 gives access inside the housing 160 as illustrated in FIGS. 2, 3. As will be evident, access inside the housing 160 allows to access the reel assembly 100 for different events such as inspection, service, part replacement or for decoupling, and taking out, the reel assembly 100 from within the housing 160.

Figure 4:
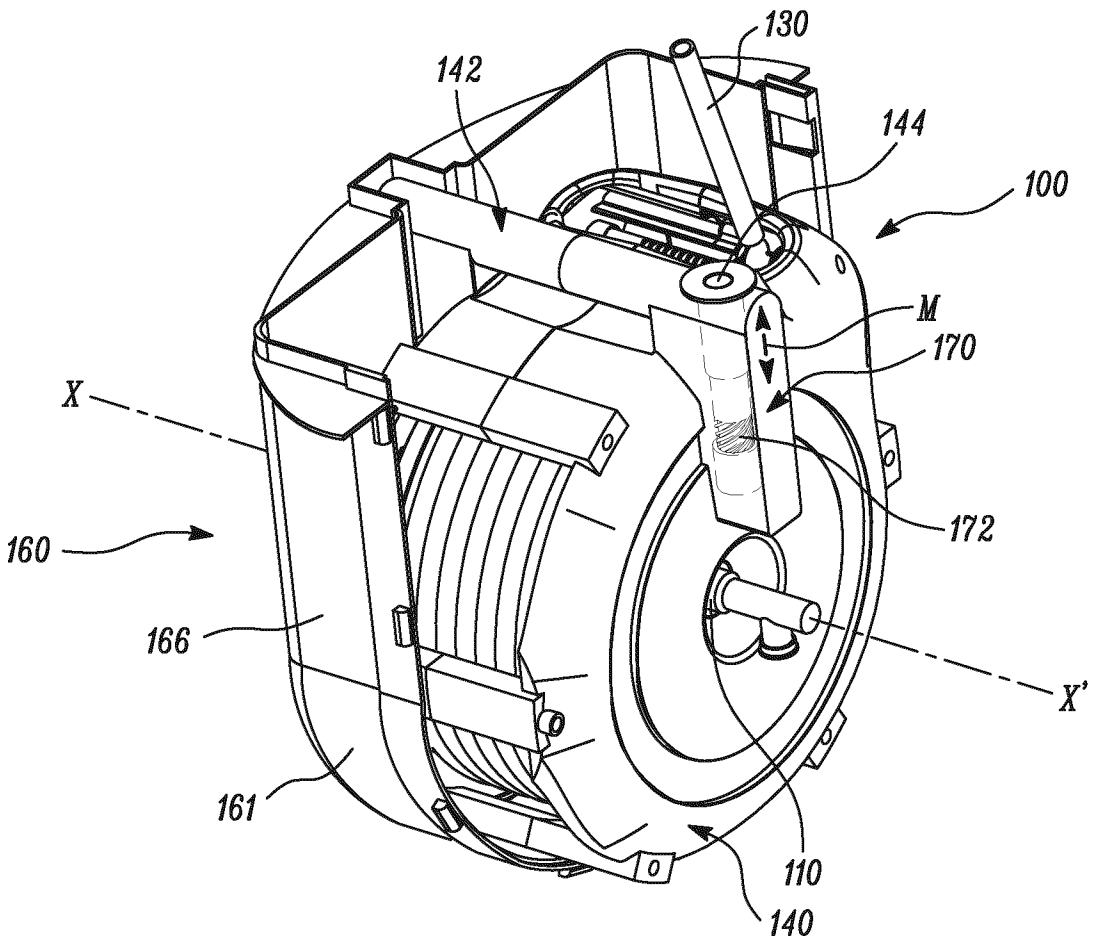
FIG. 4 shows a perspective view of the housing without a part thereof to display a reel assembly, in accordance with an aspect of the present disclosure.

Referring to FIGS. 2, 3, and 4, the reel assembly 100 includes an axle 110, and a reel 120 (shown in FIG. 6) defining a rotational axis X-X'. The reel 120 is rotatably mounted around the axle 110 to allow winding of the watering hose 130 on the reel 120. The reel assembly 100 further includes a frame 140 which houses the reel 120. Moreover, the reel assembly 100 includes one or more fixing units 150 to removably fix the reel assembly 100 inside the housing 160. The reel assembly 100 further includes a blocking mechanism 170 that operatively couples with the reel assembly 100 and cooperates with the reel 120 for selective rotation of the reel 120. The blocking mechanism 170 may engage or disengage with the reel 120 to allows or disallow respectively of the reel 120, which is referred to as "selective rotation" in the present disclosure. The blocking mechanism 170 disallows rotation of the reel 120 in absence of coupling of the reel assembly 100 within the housing 160.

As illustrated in FIGS. 2, 3 and 4, the blocking mechanism 170 is a turning block 172 in the form of a movable screw or a bolt that is fixed to the frame 140, or a handle 142 or the fixing units 150. The choice of the blocking mechanism 170 may depend upon the type, dimension, service life and other factors related to the hose 130 and the reel assembly 100. Preferably, the blocking mechanism 170 may be a movable screw or bolt, which is easy to install, easily serviceable and available in different shapes and sizes to cater to the need of different applications. The turning block 172 as illustrated in FIG. 4 is fixed to one or more of the handle 142 or the fixing units 150 and is generally perpendicular to the rotational axis X-X' of the reel 120. The turning block 172 exhibits up and down movement "M" to disengage and engage with the reel 120, respectively. The turning block 172 is one or more of substantially parallel, perpendicular or pivoted with respect to the rotational axis X-X'. In some embodiments, the turning block 172 may move in parallel along the rotational axis X-X' of the reel 120 or is pivoted towards or away from the reel 120.

The housing 160 as illustrated in FIGS. 2 and 3 includes an actuator 162 which engages with the blocking mechanism 170 of the reel assembly 100. The actuator 162 engages with the blocking mechanism 170 to unlock or disengage the reel 120 from the blocking mechanism 170, on coupling of the housing 160 and the reel assembly 100. During coupling of the housing 160 and the reel assembly 100, the turning block 172 moves away from the reel 120.

In some embodiments, the blocking mechanism 170 is manually actuable to allow or disallow the rotation of the reel 120. The provision of manual actuation of the blocking mechanism 170 allows a user to block the rotation of the reel 120 according to different application requirements. The grip or handle 142 includes a switch or a button 144 to trigger the interaction of the blocking mechanism 170 to prevent the rotation of the reel 120. The provision of the switch or the button 144 on the grip or the handle 142 makes the blocking mechanism 170 ergonomic and easy to operate.

The switches and the button 144 are inexpensive, simple to attach, replaceable and take up less space on the handle 142.

Figure 5:
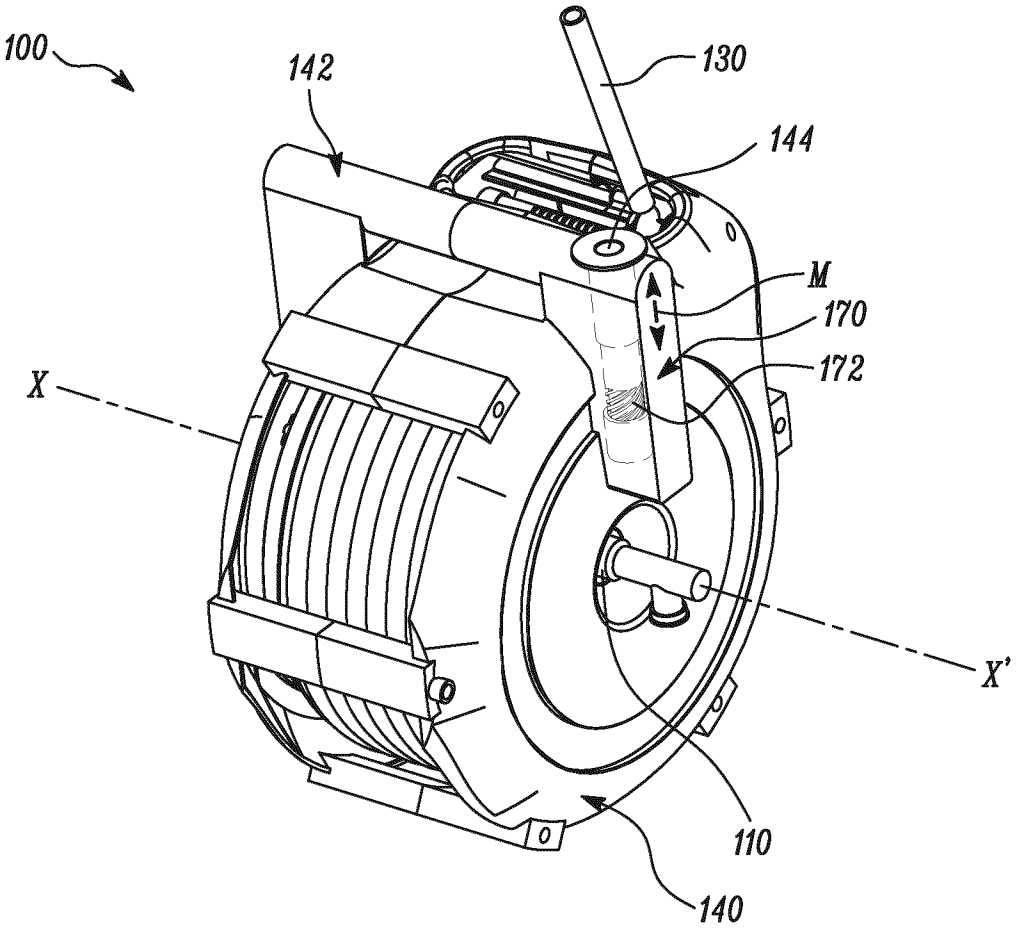
FIG. 5 shows a perspective view of a reel assembly, in accordance with an aspect of the present disclosure.
Figure 6:
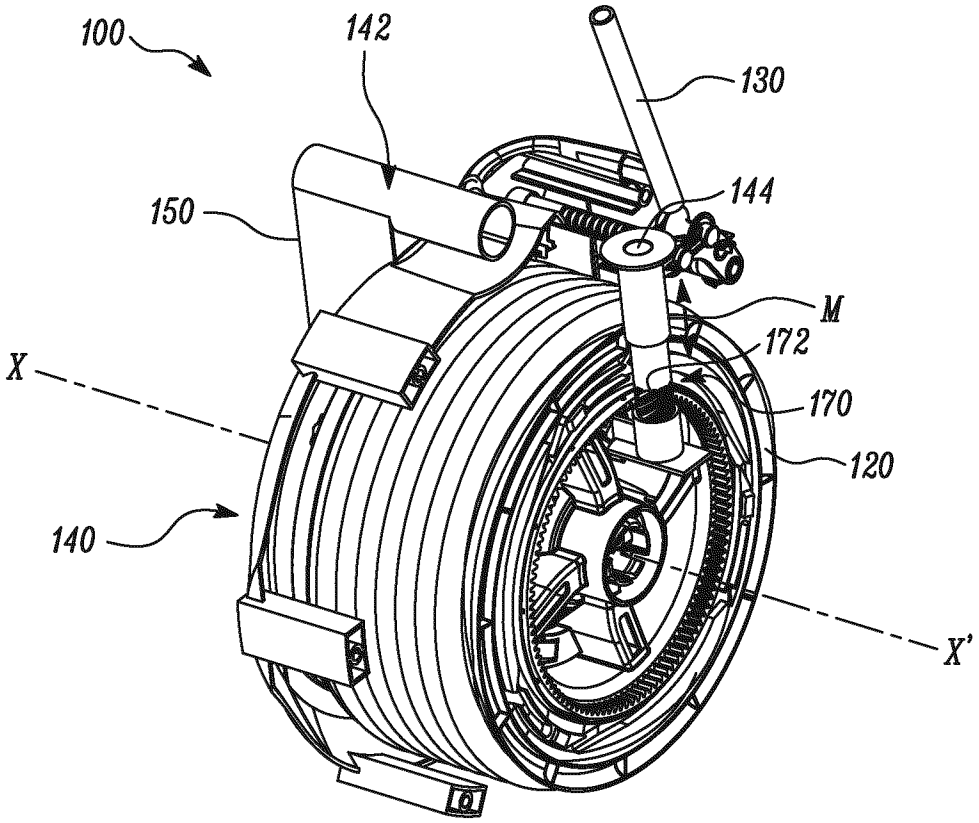
FIG. 6 shows a partial cross-section view of a reel assembly, in accordance with an aspect of the present disclosure.

FIGS. 5 and 6 illustrate the turning block 172 in engagement with the reel 120 when outside the housing 160. In this engaged position, rotation of the reel 120 is disallowed, which takes place due to absence of the actuator 162 which engages with the blocking mechanism 170 of the reel assembly 100. Particularly, FIG. 6 illustrates relative position and relation of the turning block 172 of the blocking mechanism 170 and the reel 120. The present figure also allows to appreciate the position and placement of the button 144 to trigger the interaction of the blocking mechanism 170 to allow or disallow, as required, the rotation of the reel 120.

The reel assembly 100 further includes a drive mechanism (not shown) configured to drive the reel 120 to wind and unwind the flexible linear component 130 (or hose 130). The drive mechanism is selected from the group including a spring, and an electric motor. The choice of the drive mechanism may be dependent on different factors such as a power source, application location, maintenance, and the like. In some embodiments, the drive mechanism may be a spring. The spring as the drive mechanism supports automatic winding of the hose 130. The spring may preferably be a torsion spring. In some embodiments, the drive mechanism may be an electric motor. The electric motor as the drive mechanism supports high-speed winding, continuous operation, and frequent operation, as well as large diameter and long hoses. Further, the motor may be a torque motor, inverter control type motor, servo motor, geared motor, or hydraulic motor.

FIGS. 2 and 3 illustrate a perspective view of the housing 160 without the cover 180 to allow access to the reel assembly 100. The reel assembly 100 in this state is coupled to the housing 160 and the reel 120 is free to rotate along its rotational axis X-X'. When the reel assembly 100 transits from over the ground (i.e., not engaged to the housing 160) to inside the housing 160, the turning block 172 which is fixed to the fixing unit 150 moves in downward direction perpendicular to the rotational axis X-X' of the reel 110. When the reel assembly 100 couples within the housing 160, the turning block 172 engages the actuator 162 attached to the housing 160, which disengages (or uncouples, unlocks) the turning block 172 from the reel 110. As a result, the reel 110 is free for rotation along its rotational axis X-X'. The hose 130 may now be easily winded and unwounded according to the requirement.

In an embodiment, the reel 110 rotation may be blocked even when the reel assembly 100 remains coupled within the housing 160. The housing 160 may be provided with a switch, a button and the like which allows the actuator 162 to be disengaged (say pivoted away) from the turning block 172 using manual or automatic means. This will allow the turning block 172 to engage the reel 100, and the hose 130 will not be available for unwinding. Such locking of the hose 130 and the reel 120, with the reel assembly 100 within the housing 160, may be applicable for long non-use periods or due to any safety or maintenance considerations.

In some embodiments, the turning block 172 may be integrated with the cover 180. Thus, the rotation of the reel 120 is permissible only when the reel assembly 100 is properly coupled within the housing 160 and covered by the cover 180.

In some embodiments, the housing inlet 168 of the housing 160 may be connected to the water connector 122 of the reel assembly 100 via a hose or any other fluid coupling as used or known in the art. This allows the fluid (say water) from the external fluid source to reach the water connector 122 and then, through the housing inlet 168 to the hose 130 wounded on the reel 120. Further, when the reel assembly 100 is required to be taken out, or disassembled from the housing 160, the hose 130 connected with the housing inlet 168 may need to be disconnected from the housing inlet 168.

Figure 7:
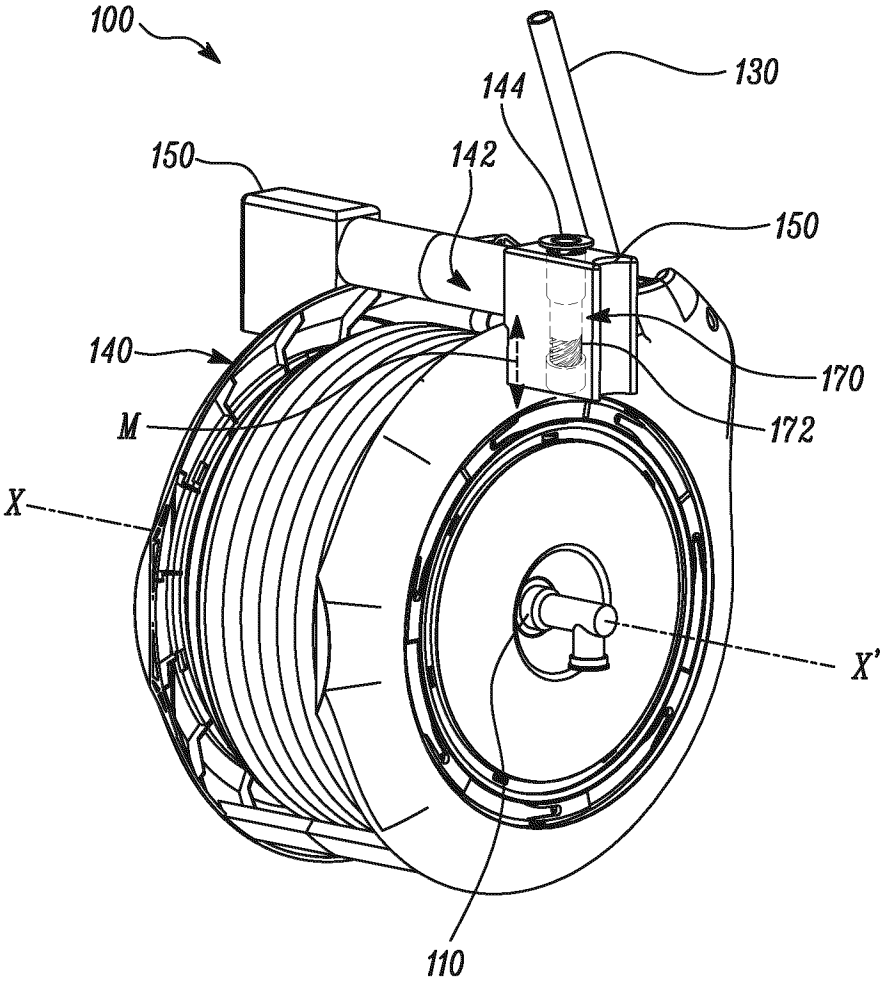
FIG. 7 shows a perspective view of a reel assembly, in accordance with an aspect of the present disclosure.
Figure 8:
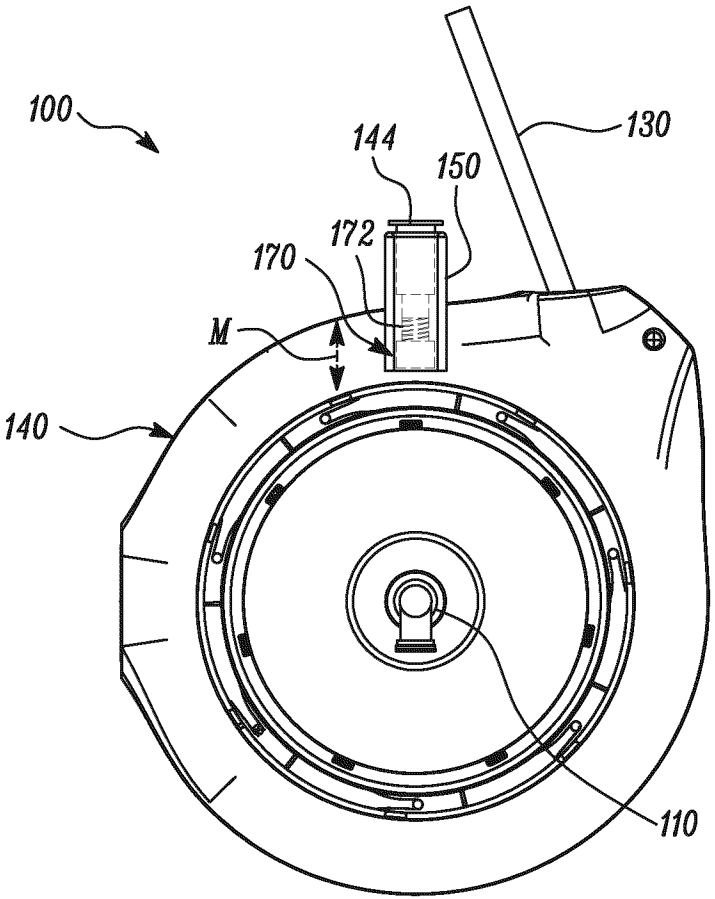
FIG. 8 shows a side view of the reel assembly, in accordance with an aspect of the present disclosure.
Figure 9:
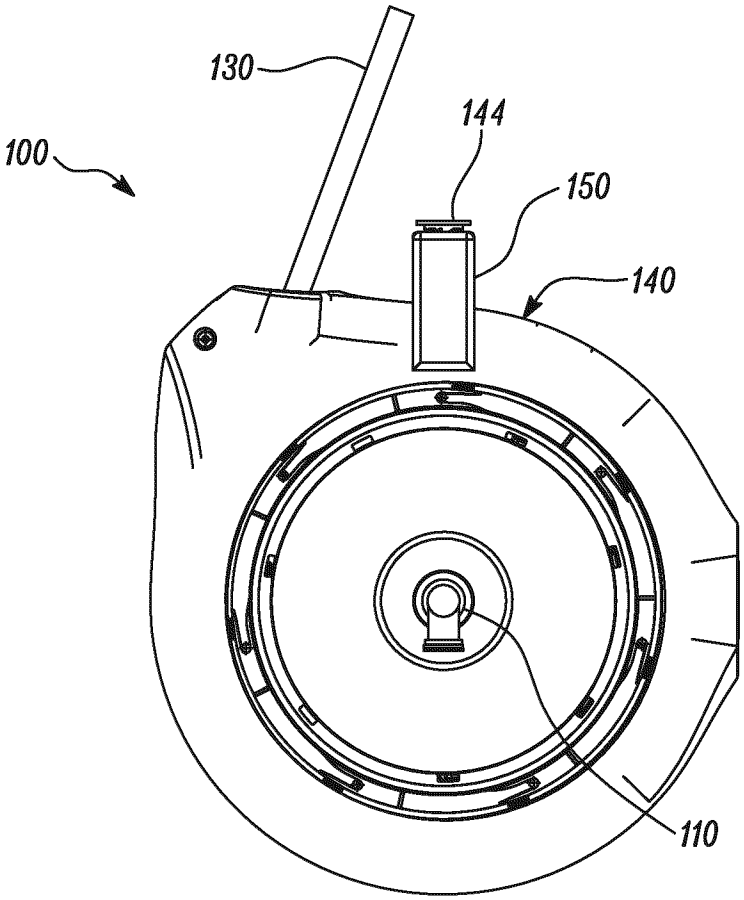
FIG. 9 shows another side view of the reel assembly, in accordance with an aspect of the present disclosure.

FIGS. 7, 8, and 9 illustrate different views of the reel assembly 100 after disassembly from the housing 160. The frame 140 includes a grip or the handle 142. The user may grip the handle 142 to pull out the frame 140 of the reel 120 out of the housing 160. For disassembly of the reel assembly 100, the handle 142 of the reel assembly 100 may be engaged to lift the reel assembly 100 from within the housing 160. Thus, provision of handle 142 on the frame 140 allows easy removal of the reel assembly 100 out of the housing 160.

In some embodiments, the grip, or the handle 142 may be integrated to the cover 180, shown in FIG. 1. The reel assembly 100 may thus be pulled out of the housing 160 directly by lifting the cover 180.

In some embodiments, the one or more fixing units 150 is selected from the group including one or more of a railing system, and a screwing mechanism. As illustrated in the present disclosure, the handle 142 of the frame 140 is connected to the one or more fixing unit 150 at its ends. During assembly or disassembly of the reel assembly 100 and the housing 160, the one or more fixing units 150 may slide up and down respectively in the rails 152 included in the side walls 164 of the housing 160. In some embodiments, the one or more fixing units 150 may simply be screwed and unscrewed from the housing 160. Such fixing units 150 may allow for easy adjustment of the frame 140, easy to install, user friendly among other implementation benefits.

In some embodiments, the blocking mechanism 170 automatically interacts with the reel 120 to prevent its rotation, when not coupled with the housing 160. This allows efficient and safe application of the blocking mechanism 170 as the blocking mechanism 170 gets automatically activated when the reel assembly 100 is manipulated, while not requiring any human intervention. This may ensure that when the reel assembly 100 is displaced from its storage position, any inadvertent reel 120 rotation is blocked. Also, if due to any external factors (say environmental disturbances), the reel assembly 100 dislocates from its storage position within the housing 160, the reel 120 rotation is automatically blocked.

FIGS. 8 and 9 illustrate different side views of the reel assembly 100 outside the housing 160. In this state uncoupled from the housing 160, the rotation of the reel 120 is blocked. The rotation of the reel 120 is blocked as there is no obstruction in the motion of the turning block 172, due to absence of the actuator 162 attached to the housing 160. The turning block 172 now moves in downward direction, as illustrated by the movement "M" in FIG. 8, substantially perpendicular to the rotational axis X-X' of the reel 120. The turning block 172 moves until it presses upon or engages with the reel 120 to block the rotation of the reel 120. Thus, the hose 130 is not available for unwinding, as the reel 120 remains engaged by the turning block 172.

The present disclosure illustrates the movement "M" of the turning block 172 by double arrows in some embodiments. This is to indicate movement allowed in both the directions (herein up and down with respect to rotational axis X-X' of the reel 120) by the turning block 172. However, the preferred and automatic movement of the turning block 172 is towards and to engage/lock the reel 120, while dedicated means such as the button 144 have been provided to stop or even reverse the movement "M" of the turning block 172 in some other embodiments.

In some embodiments, the axle 110 may be integrally molded in the reel 120. Further, the axle 110 may be a continuous axle or a stub axle. The axle 110 may be made hollow to accommodate wirings or other accessories of a drive mechanism (not shown) to wind and unwind the reel 120.

In some embodiments, the reel 120 may be manufactured in multiple parts from a suitable plastic material and the multiple parts may then be assembled. The reel 120 may be manufactured in a molded form from a plastic material and substantially in one piece. The reel 120 may even be manufactured from materials such as wood, fiberglass, or metal like heavy-gauge steel, stainless steel, aluminum, and the like. The frame 140 may be made from the same material as the reel 120 and to stabilize the reel 120 inside the housing 160.

Thus, the present disclosure provides a simple, efficient, and safe reel assembly 100 suitable for applications with the underground housing 160. This allows to selectively restrict undesirable movement say unwinding of the hose 130 for the reel assembly 100 outside the housing 160. The reel assembly 100 includes the blocking mechanism 170 which disallows rotation of the reel 120 and the hose 130, when the reel assembly 100 is taken outside the housing 160. The blocking mechanism 170 of the reel assembly 100 allows to meet statutory requirement and helps to avoid injury to a user due to accidental rotation of the reel 120. Further, application of the blocking mechanism 170 allows to avoid unnecessary effort (say due to inadvertent hose unwinding) on the part of the user to maintain the hose 130 intact on the hose reel 120. The blocking mechanism 170 also avoids unnecessary frictional contact of the hose 130 and therefore avoids wear and tear of the hose 130.

In the drawings and specification, there have been disclosed preferred embodiments and examples of the invention and, although specific terms are employed, they are used in a generic and descriptive sense only and not for the purpose of limitation of the scope of the invention being set forth in the following claims.

LIST OF ELEMENTS

100 Reel Assembly
110 Axle
120 Reel
122 Water Connector
130 Flexible Linear Component/Hose
140 Frame
142 Handle
144 Button
150 Fixing Units
152 Rail
160 Housing
161 Body
162 Actuator
164 Side Walls
166 Front Walls
168 Housing Inlet
170 Blocking Mechanism
172 Turning Block
180 Cover
182 Hole
190 Ground Surface
X-X' Rotational Axis
M Movement

The invention claimed is:

1. A reel assembly for a watering hose for coupling within a housing, comprising:

an axle;

a reel defining a rotational axis, wherein the reel is rotatably mounted around the axle to allow winding of the watering hose on the reel;

a frame which houses the reel; and one or more fixing units to removably fix the reel assembly inside the housing;

wherein the housing includes a pair of side walls and a pair of front walls, wherein at least one of the pair of side walls and the pair of front walls includes a housing inlet, wherein the housing inlet is or can be associated with a water connector to fluidly couple the watering hose with a fluid line or hose to supply water from an external fluid source;

wherein the reel assembly further comprises a blocking mechanism that operatively couples with the reel assembly and cooperates with the reel for selective rotation of the reel; and wherein the blocking mechanism disables rotation of the reel responsive to the reel assembly being removed from coupling with the housing.

2. The reel assembly of claim 1, wherein the water connector removably couples with the fluid line or hose to supply water from the external fluid source.

3. The reel assembly of claim 1, wherein a disconnection of the water connector and the fluid line or hose seals the fluid line or hose to stop the supply of water from the external fluid source.

4. The reel assembly of claim 3, wherein the disconnection and sealing of the fluid line or hose takes place automatically in the absence of coupling of the water connector.

5. The reel assembly of claim 1, wherein the blocking mechanism automatically interacts with the reel to prevent rotation of the reel, when not coupled with the housing.

6. The reel assembly of claim 1, wherein the frame also includes a grip or a handle.

7. The reel assembly of claim 6, wherein the blocking mechanism gets automatically activated when the reel assembly is manipulated.

8. The reel assembly of claim 6, wherein the grip or handle includes a switch or a button to trigger the blocking mechanism to prevent the rotation of the reel.

9. The reel assembly of claim 1, wherein the housing includes an actuator which engages with the blocking mechanism of the reel assembly.

10. The reel assembly of claim 9, wherein the actuator enables rotation of the reel assembly by engaging the blocking mechanism responsive to operably coupling the reel assembly to the housing.

11. The reel assembly of claim 1, wherein the blocking mechanism is manually actuable to allow or disallow the rotation of the reel.

12. The reel assembly of claim 1, wherein the reel assembly further includes a drive mechanism configured to drive the reel to wind and unwind the hose for watering.

13. The reel assembly of claim 1, wherein the drive mechanism is selected from a group including a spring, and an electric motor.

14. The reel assembly of claim 1, wherein the one or more fixing units is selected from the group including one or more of a railing system, and a screwing mechanism.

15. A reel assembly for a watering hose for coupling within a housing, comprising:

an axle;

a reel defining a rotational axis, wherein the reel is rotatably mounted around the axle to allow winding of the watering hose on the reel;

a frame which houses the reel; and one or more fixing units to removably fix the reel assembly inside the housing;

wherein the housing includes a pair of side walls and a pair of front walls, wherein at least one of the pair of side walls and the pair of front walls includes a housing inlet, wherein the housing inlet is or can be associated with a water connector to fluidly couple the watering hose with a fluid line or hose to supply water from an external fluid source;

wherein the reel assembly further comprises a blocking mechanism that operatively couples with the reel assembly and cooperates with the reel for selective rotation of the reel; and wherein the blocking mechanism disallows rotation of the reel in absence of coupling of the reel assembly within the housing, wherein the blocking mechanism is a turning block in form of a movable screw or a bolt that is fixed to the frame, wherein the turning block is one or more of substantially parallel, perpendicular or pivoted with respect to the rotational axis of the reel.

* * * * *